United States Patent [19]

Wehrell

[11] Patent Number: 4,968,028

[45] **Date of Patent: * Nov. 6, 1990**

[54] VERTICAL JUMP EXERCISE APPARATUS

[76] Inventor: Michael Wehrell, 2648 The Strand, Hermosa Beach, Calif. 90254

[ * ] Notice: The portion of the term of this patent subsequent to Sep. 10, 2006 has been disclaimed.

[21] Appl. No.: 359,632

[22] Filed: May 31, 1989

Related U.S. Application Data

[63] Continuation-in-part of Ser. No. 200,964, Jun. 1, 1988, Pat. No. 4,863,163.

[51] Int. Cl.[5] ..... A63B 21/055; A63B 21/02

[52] U.S. Cl. ..... 272/138; 272/139; 272/142

[58] Field of Search ..... 272/138, 137, 139, 142, 272/109

[56] References Cited

U.S. PATENT DOCUMENTS

| | | | |
|---|---|---|---|
| 546,568 | 9/1895 | Whitely | 272/142 |
| 1,623,670 | 4/1927 | Frankenfeld | 272/138 |
| 3,162,441 | 12/1964 | Karlik | 272/139 |
| 3,432,163 | 3/1969 | Murphy | 272/109 |
| 3,561,758 | 2/1971 | Huber | 272/138 |
| 3,687,450 | 8/1972 | Schollmeyer | 272/137 |
| 4,371,162 | 2/1983 | Hartzell | 272/138 |
| 4,685,670 | 8/1987 | Zinkin | 272/142 |

OTHER PUBLICATIONS

"Russian Leaper", Volleyball Monthly, 10/87 p. 59.

*Primary Examiner*—Randall L. Green
*Assistant Examiner*—David H. Willse
*Attorney, Agent, or Firm*—Rogers & Killeen

[57] ABSTRACT

A vertical jump exercise apparatus may be used to train and condition participants in sports demanding a high degree of vertical jumping ability. Elastic codes fastened to the waist of the user provide a nearly constant resistive force, thereby simulating increased body weight to strengthen leg muscles and to improve motor reflexes. Generation of the nearly constant force is accomplished by directing one or more of the elastic cords beneath or away from the exercise area, thus allowing use of an increased length of cord. Directional control for the jumper, cord following to prevent fouling of the cord, and reduced friction are provided by movable tracking assemblies that may pivot or move linearly and may be provided with pulleys. The tracking assemblies may also serve as force imbalance indicators for the elastic cords.

22 Claims, 14 Drawing Sheets

VERTICAL JUMP EXERCISE APPARATUS

BACKGROUND OF THE INVENTION

This invention a continuation-in-part application of U.S. Pat. application Ser. No. 200,964, filed June 1, 1988, U.S. Pat. No. 4,863,163.

The present invention relates to a vertical jump exercise apparatus for training and conditioning participants in sports activities that call for highly developed jumping abilities. People with the higher vertical jump capability often have a competitive edge in such sports as volleyball, basketball, track, and football. The invention also has utility in training and conditioning for jump recovery for sports such as water and snow skiing.

Leg training and conditioning have long been recognized as desirable, and various proposals have been advanced. Some devices, such as that disclosed in Hartzell U.S. Pat. No. 4,371,162, dated Feb. 1, 1983, for squatting exercises, are unsuited for jumping. In jump training, one approach, (such as disclosed in the advertisement for a "Russian Leaper" in *Volleyball Monthly*, October 1987, p. 59) utilizes short elastic cords attached to the top of a platform, but provides, in contrast to the present invention, no resistive force in the squatted position, no means to monitor symmetrical equivalence of elastic cord tensions for jumper safety, and no means to adjust resistive forces without disassembling the apparatus.

Training devices embodying a relatively constant resistive force, but without means to track cord movement, are disclosed in the Huber U.S. Pat. No. 3,561,758, dated Feb. 9, 1971, and the Schollmeyer U.S. Pat. No. 3,687,450, dated Aug. 29, 1972. Such devices make no provision for reducing friction at the points at which the cords emerge from the apparatus en route to attach to the user. The cords of these devices will inherently rub against the nonmoving surfaces from which they emerge and create a destructive and undesired frictional force.

Other training devices embodying a relatively constant resistive force with track cord movement are disclosed, e.g., in the Zinkin U.S. Pat. No. 4,685,670, dated Aug. 11, 1987. Such devices are only capable of transmitting forces in a one-dimensional plane. Thus, the entire device embodying all moving parts, force elements, and restraining devices must rotate with the user to track movement. This requires a user of his device to provide a generally nontransportable means of support such as a doorway, or roof. Moreover, the rigid bodies restraining force elements of such devices must be physically displaced or reconfigured to adjust tension.

Vertical jump conditioning and training is accomplished by strengthening leg muscles and increasing the speed of the motor reflexes of the legs.

Leg muscles are strengthened by simulating an increase in body weight at or near the user's center of gravity during jump training. Leg strengthening is accomplished in the present invention by providing a waist band with elastic cords attached to a base. The user jumps against the resistive force of the elastic cords, simulating an increase in weight. The resistive force is adjustable to fit the needs of the user.

Motor reflexes of the legs cannot be maintained if a person increases his leg strength performing slow-motion exercises with weights, such as squats or leg presses. When a person loses the ability to jump quickly from the squatting position to the extended leg position, he loses the ability to gain the inertia to propel him into the air after the feet leave the ground. This can result in a lower vertical jump even after an increase of leg strength is acquired.

To maintain quick motor reflexes while increasing one's leg strength for jumping purposes, a person must perform the leg exercises at speeds near his natural jumping speed. This can only be accomplished if the device attached to the user does not have a large mass with inherent inertia which will resist acceleration. A person using conventional exercise devices with free weight cannot move at natural speeds because he must deal with the inherent inertia of the motionless weight being used. It takes much more energy to start and stop 100 pounds of dead weight at jumping speeds than a couple of ounces of shockcord which can provide the same 100 pounds of resistance through the same range of motion. The present invention allows the jumping exercise to be performed at near natural speeds because the source of resistance only weighs ounces. Thus, the unbalancing and dangerous forces of inertia created by accelerating dead weight to jumping speeds are virtually eliminated.

The present invention provides nearly constant resistive force throughout the range of the jump. In other words, from the minimum squatting height of any user to the fully extended leg position of the jump, the simulated weight increase is nearly constant. Without this feature, the force exerted on the jumper in the squatting position of the jump would be far less than the force applied at the point where the jumper's feet are extended and about to leave the ground. This causes the user to miss the benefits of exercising the legs in the squatting position of the jump where humans have a mechanical disadvantage against accelerating upward. Users of this type of device, such as the referenced "Russian Leaper", also incur an unpleasant and potentially harmful snap-back midway through the upward motion of the jump where slack in the elastic cord is finally reduced to zero.

During repetitive jumping exercises, a jumper may move from the center of the exercise area, and it is therefore desirable that a jump exercise device provide forces tending to restore the jumper to the center of the exercise area. Such centering forces should not be so strong as to pull an off-center jumper off balance. The present invention may provide an adjustable centering force that may gradually move the jumper back to the center of the area.

In the preferred embodiment, the present invention employs elastic cords attached to a waist band on the user and to a platform forming an exercise area. The effective length of the cords is increased by directing the cords beneath the platform and routing them through a series of pulleys. A tracking device that directs each cord from the exercise area to beneath the platform includes pulleys and a movable frame to decrease friction and to follow off-center motion of the cord. The frame may be mounted on a pivot for arcuate motion or on a rail for linear motion. The movable frame is particularly important in a jump exerciser because of uncertain directional control of the jumper that may tend to derail the cord.

Accordingly, it is an object of the present invention to provide a vertical jump exercise apparatus that obviates the problems of the prior art and that is usable in a variety of locations.

It is another object of the present invention to provide a vertical jump exercise apparatus with means to follow rapid and off-center jumps while maintaining the resistive force cords on the guide pulleys.

It is yet another object of the present invention to provide a novel vertical jump exercise apparatus that has a nearly constant resistive force through the full range of any user's jumping motion.

It is a further object of the present invention to provide a vertical jump exercise apparatus with an adjustable resistive force, and one which may be adjusted without reconfiguring the position of any rigid body of the device or interchanging parts.

It is yet a further object of the present invention to provide a vertical jump exercise apparatus with a visual indication when there is a resistive imbalance between any cords, and which provides means for easily correcting any undesired imbalance.

It is yet still a further object of the present invention to provide a vertical jump exercising apparatus in which the user can set the resistance from ground zero of the jumping surface.

It is still a further object of the present invention to provide a vertical jump exercise apparatus with relatively low friction at each point the resistive force cord changes direction, by making all surfaces with which the force element can come in contact freely moving.

These and many other objects and advantages will be readily apparent to one skilled in the art to which the invention pertains from a perusal of the claims and the following detailed description of preferred embodiments when read in conjunction with the appended drawings.

THE DRAWINGS

DETAILED DESCRIPTION OF PREFERRED EMBODIMENTS

With reference to the figures where like elements have been given like numerical designations to facilitate an understanding of the present invention, and particularly with reference to the first embodiment of the vertical jump exercise apparatus of the present invention illustrated in FIGS. 1-7, the apparatus may be constructed of a jumping platform or base 10, elastic cords 20 waist belt 30, and tracking assemblies 40.

Figure 1:
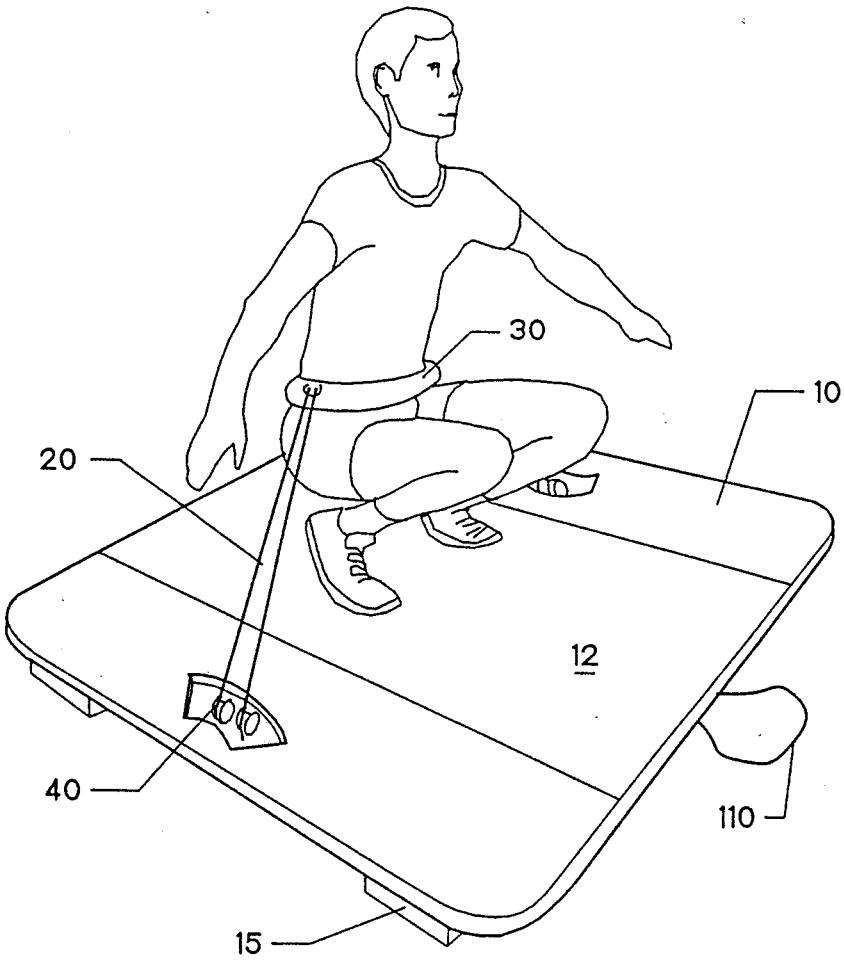
FIG. 1 is a pictorial view of a first embodiment of the present invention with the user preparing to jump, showing the restraining means providing a specified user resistance in the retracted position with reference to the jumper.
Figure 2:
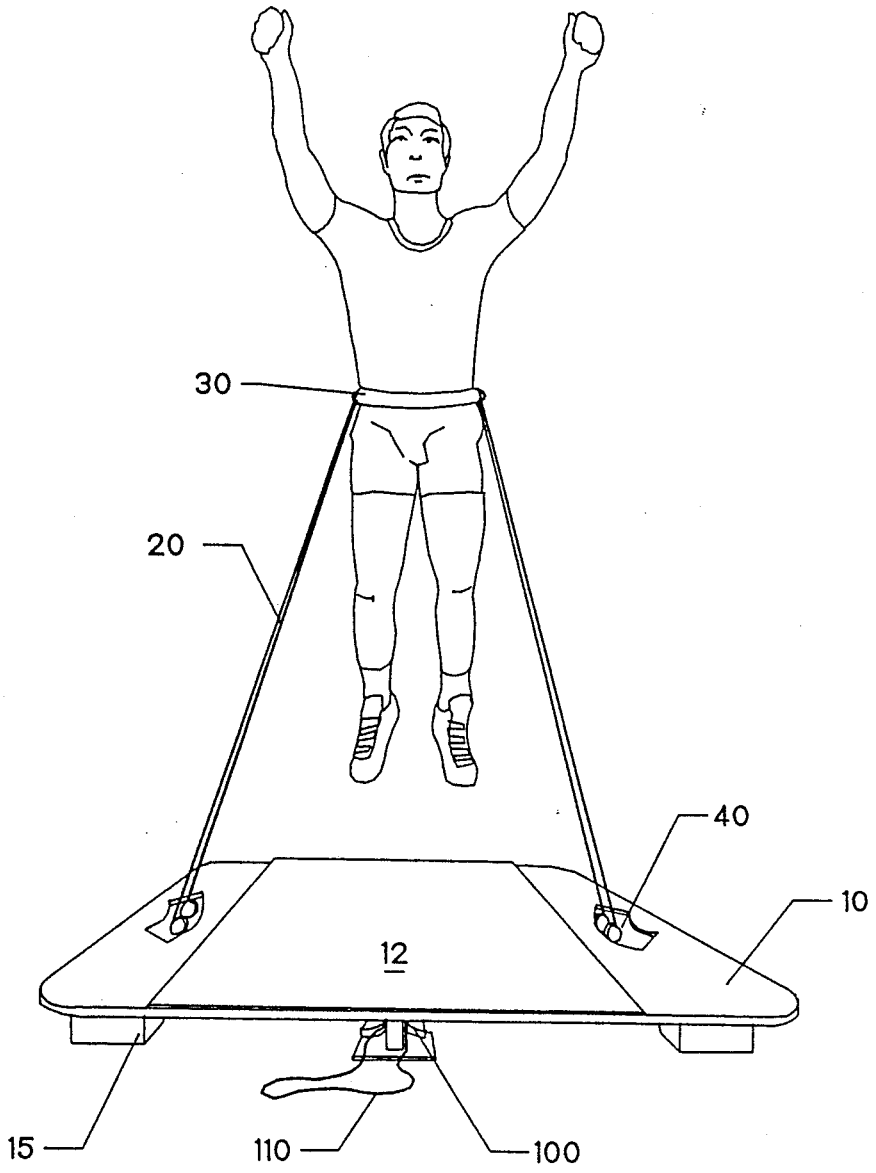
FIG. 2 is a pictorial view of the embodiment of FIG. 1 with the user at the peak of the jump, showing the restraining means in an extended position.

The apparatus may be more clearly seen in FIGS. 1 and 2 wherein a user extends the elastic cords 20 by leaping against the resistive force imposed by the cords. The area on the upper surface of the platform 10 between the tracking assemblies 40 forms an exercise area 12 for the jumping exercise, or for any other kinetic exercise that the user may devise.

The belt 30 may be made of any suitable material. It should be adjustable to fit snugly on the user and padded to prevent chaffing.

The cords 20 are elastic members that are attached to the belt 30 with any suitable detachable clip (not shown). The cords may be made of elastic material such as "shockcord" or the like. As seen in FIGS. 1-2, two cords 20 may be used, both ends of each cord 20 being attached to the belt 30. The number of cords provided may vary, provided the resistive force is made symmetric with respect to the user. Cord length is dependent on the type of elastic material and the embodiment chosen. The minimum unextended cord length for "shockcord" in the embodiment of FIGS. 1-3 is approximately 20 feet.

The base 10 may be elevated and may have supports 15 on the lower surface. The upper surface should be flat. The exercise area 12 may be cushioned and/or covered with a nonskid material (not shown).

Figure 3:
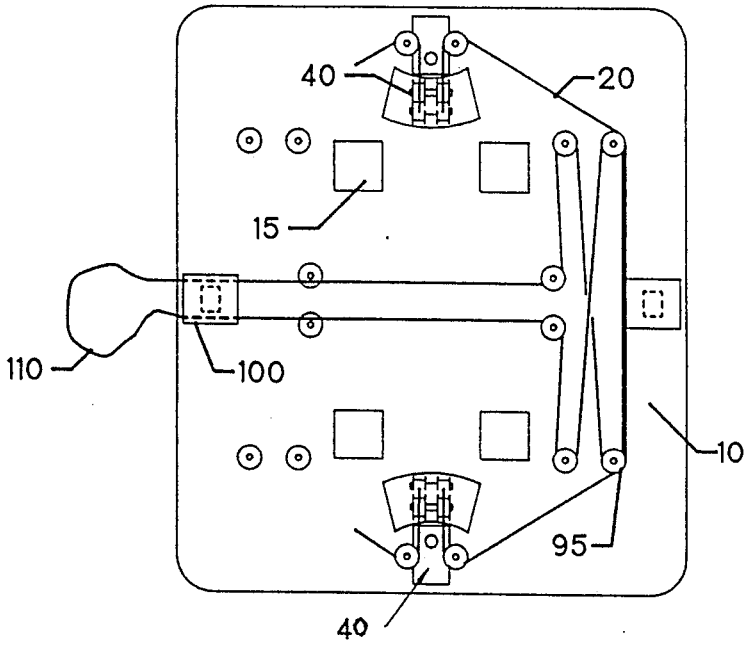
FIG. 3 is a top plan view of the embodiment of FIG. 1 as seen through the jumping platform. This figure illustrates one cord path of which the mirror image of the second cord path, for simplicity, is not shown.

The top plan view of the embodiment of FIG. 1 as seen from the bottom of the base 10 is shown in FIG. 3. The cords 20 are routed to the bottom of the base 10 by the tracking assemblies 40. The cord path may be defined by single or double pulleys 95 or similar low friction guide members. The path for each cord should be approximately the same length and extend beyond the boundary of the base 10 forming a loop 110. A releasable one-direction cleat 100 such as a "jam cleat" may be used to adjust cord length, thereby changing its effective resistive force. The loop 110 forms a handle for simple adjustment by a user in the exercise area 12.

Figure 4:
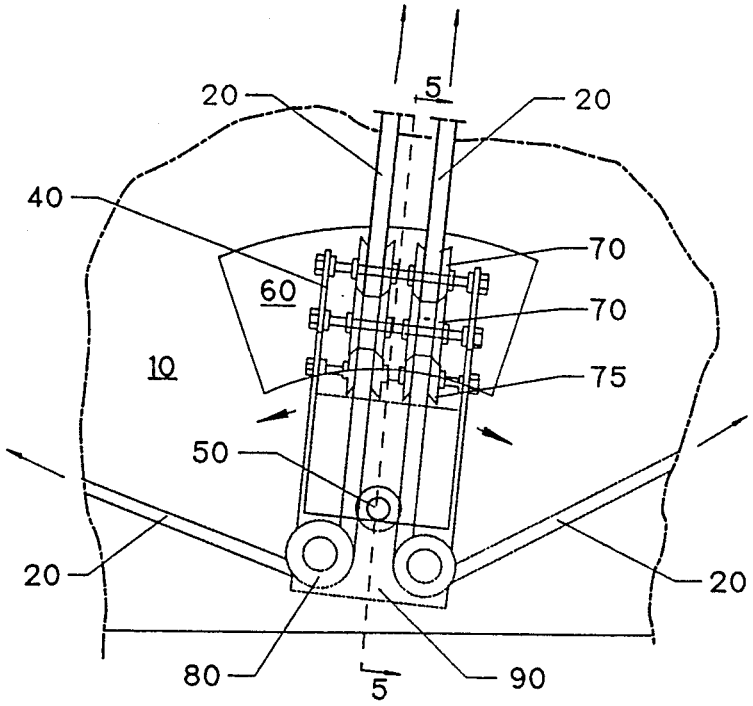
FIG. 4 is a top plan view of one of the tracking assemblies of FIGS. 1-3.
Figure 5:
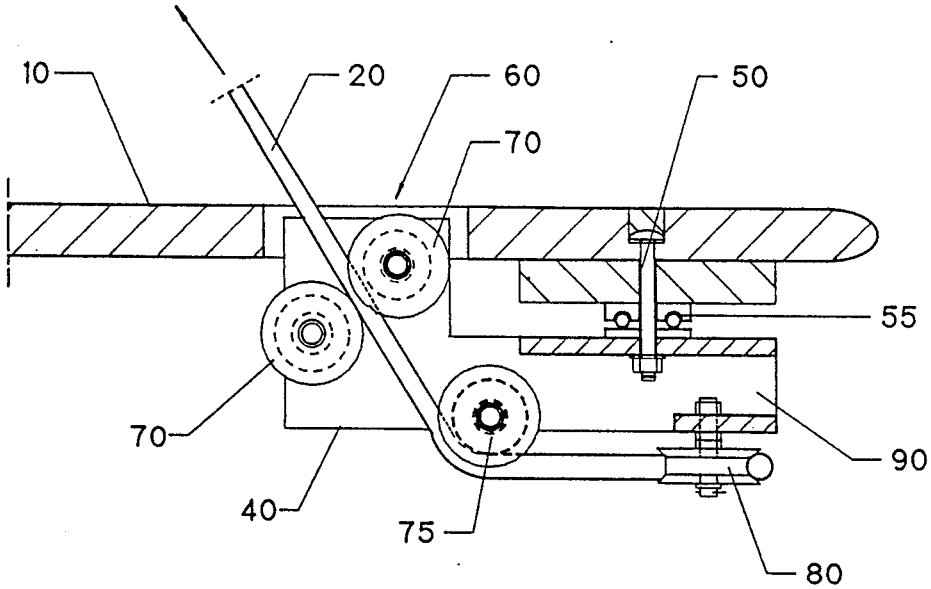
FIG. 5 is a section in elevation taken through lines 5—5 of FIG. 4.

The tracking assembly 40 may be more clearly seen in FIG. 4 (a top view) and FIG. 5 (a side view in cross-section) wherein it is affixed to the lower surface of the base 10.

A pivot bolt 50 permits the assembly 40 to rotate through an arc that may be defined by an arcuate cutout section 60 in the base 10. The pivot 50 may include a bearing 55 to reduce friction. Four upper guide pulleys 70 adjacent the upper surface of the base 10 are positioned to prevent disengagement of the cord 20 from the assembly 40. Two other guide pulleys 75 may be positioned to receive the cords 20 from the upper guide pulleys 70 and direct them to the guide pulleys 80 that direct the cords to the defined path beneath the base 10.

A suitable frame 90 to hold the pulleys 70, 75, and 80, and the pivot 50 is provided.

Figure 6:
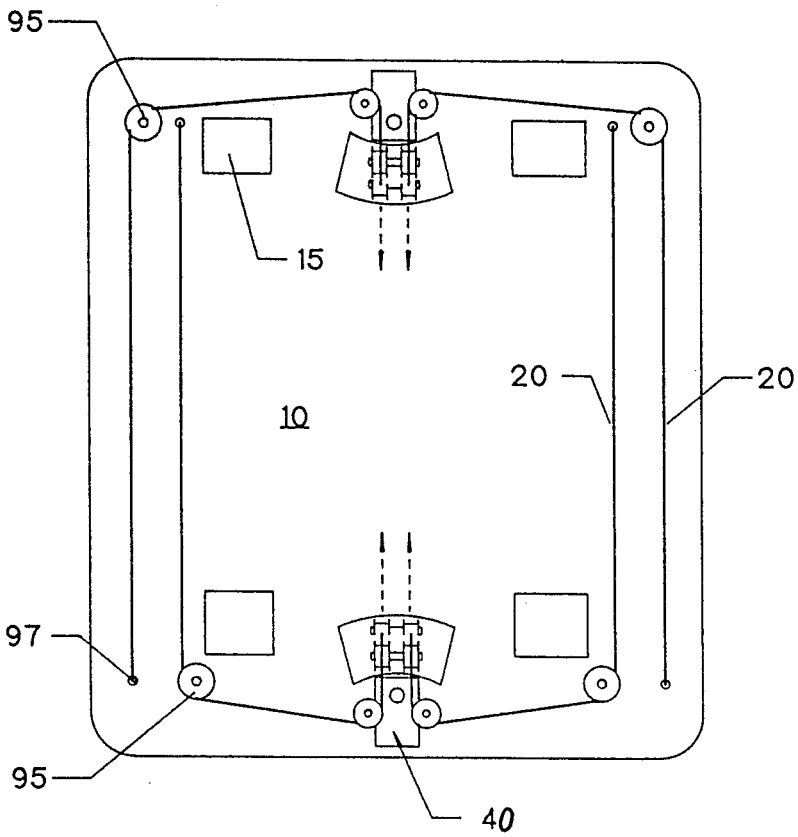
FIG. 6 is a schematic drawing illustrating an alternative cord path beneath the base of the embodiment of FIG. 1.
Figure 7:
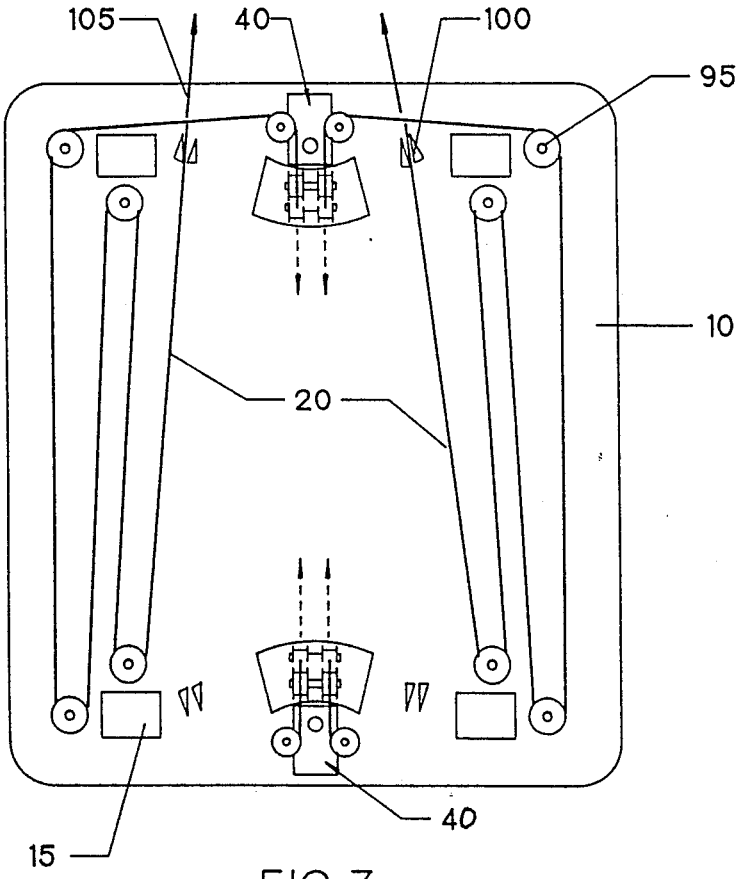
FIG. 7 is a schematic drawing illustrating a second alternative cord path beneath the base of the embodiment of FIG. 1.

The path for the cords 20 beneath the base 10 is shown in alternative embodiments in FIGS. 6 and 7. Other paths may be devised embodying the principles disclosed herein. As was shown in FIG. 3, the path may be defined by single or double pulleys 95 or similar low friction guide members. The path for each cord may terminate beneath the base 10 at fixed points 97 as seen in FIG. 6 without means to adjust the resistive force, or may extend beyond the boundary of the base 10 with free ends 105 for adjusting the resistive force with a cleat 100, as seen in FIG. 7. The paths for only one of the two sets of cords are shown in FIGS. 3 and 7 for clarity.

The force on each cord may be equalized by viewing the results of adjustments at the tracking assembly 40. When the forces are not equal, the tracking assembly 40 will be displaced from a centered position by the cord with the stronger force. The user easily may visually check the tracking device for off-centering.

Figure 8:
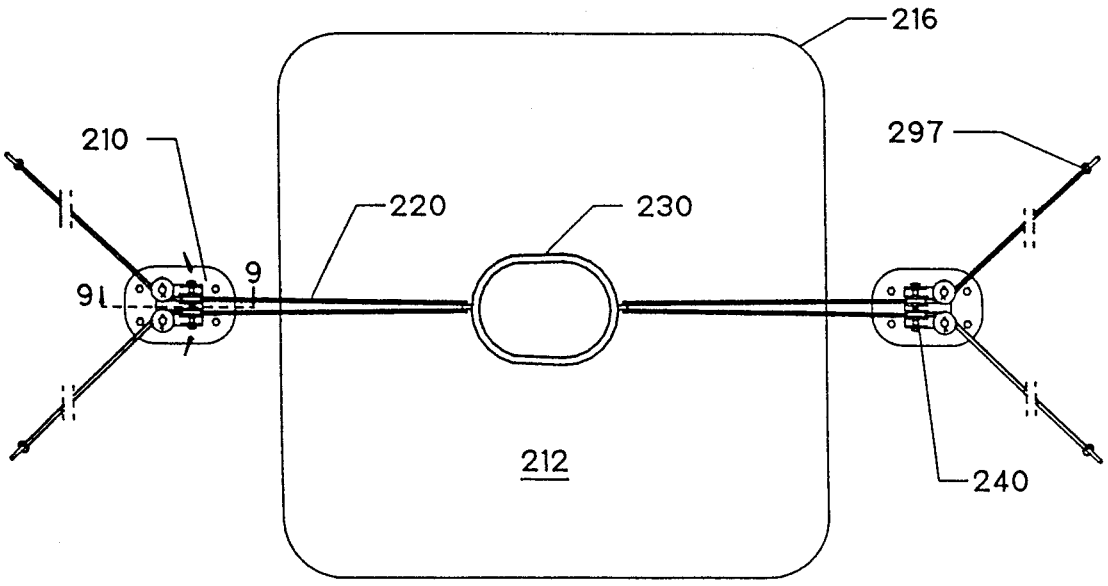
FIG. 8 is a pictorial depiction of another embodiment of the present invention.

Another embodiment of the present invention is shown in FIG. 8. Each tracking assembly 240 is attached to the upper surface of a base 210. The cords 220, attached to a belt 230, may be routed away from the base 210 and secured to a suitable fixture 297. The exercise area 212 between the tracking assemblies 240 may have a portable mat 216. The base 210 should be immobilized and able to withstand a vertical force of at least 50 pounds.

Figure 9:
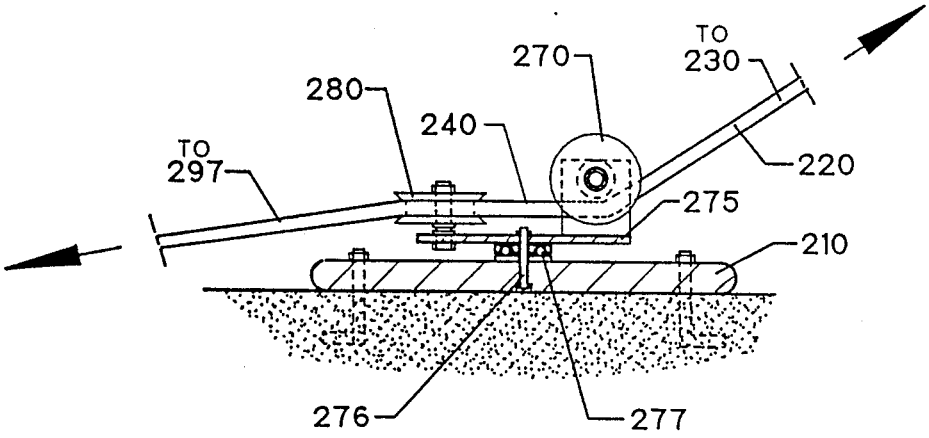
FIG. 9 is a side view depicting one embodiment of the tracking assembly of FIG. 8.

As seen in FIG. 9, the tracking assembly 240 may include first guide pulleys 270 mounted on pivoting frame 275 attached to the base 210 with a pivot bolt 276 and bearings 277. Second direction change guide pulleys 280 are also attached to the frame 275.

This embodiment may find utility as a portable unit or for specialized training from a sand filled exercise area 212 without a mat.

Figure 10:
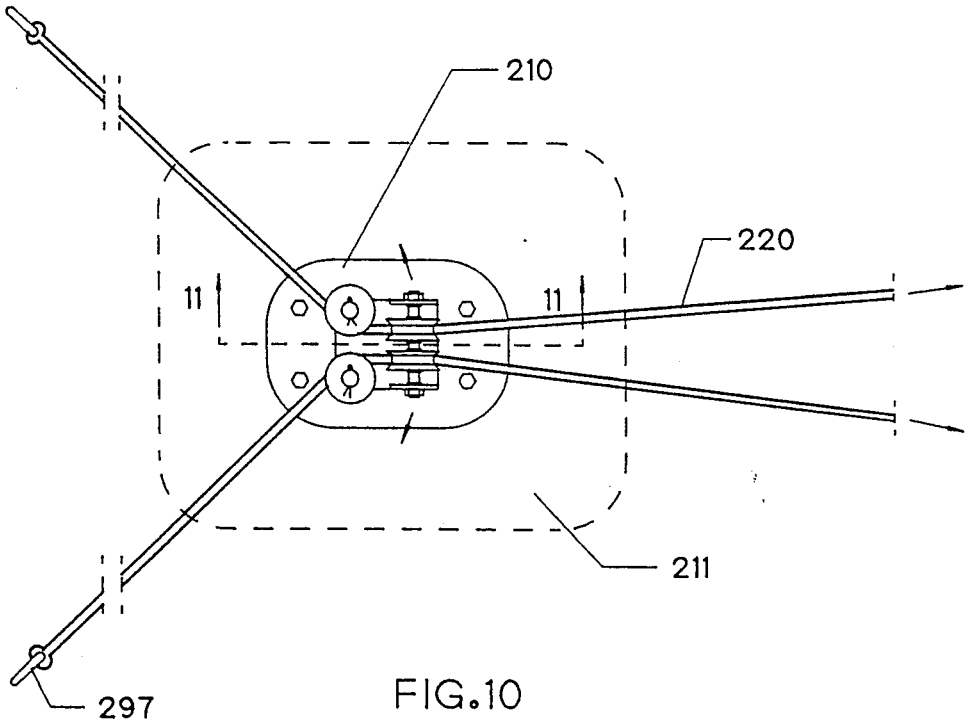
FIG. 10 is a top plan view of a second embodiment of the base of FIG. 8.
Figure 11:
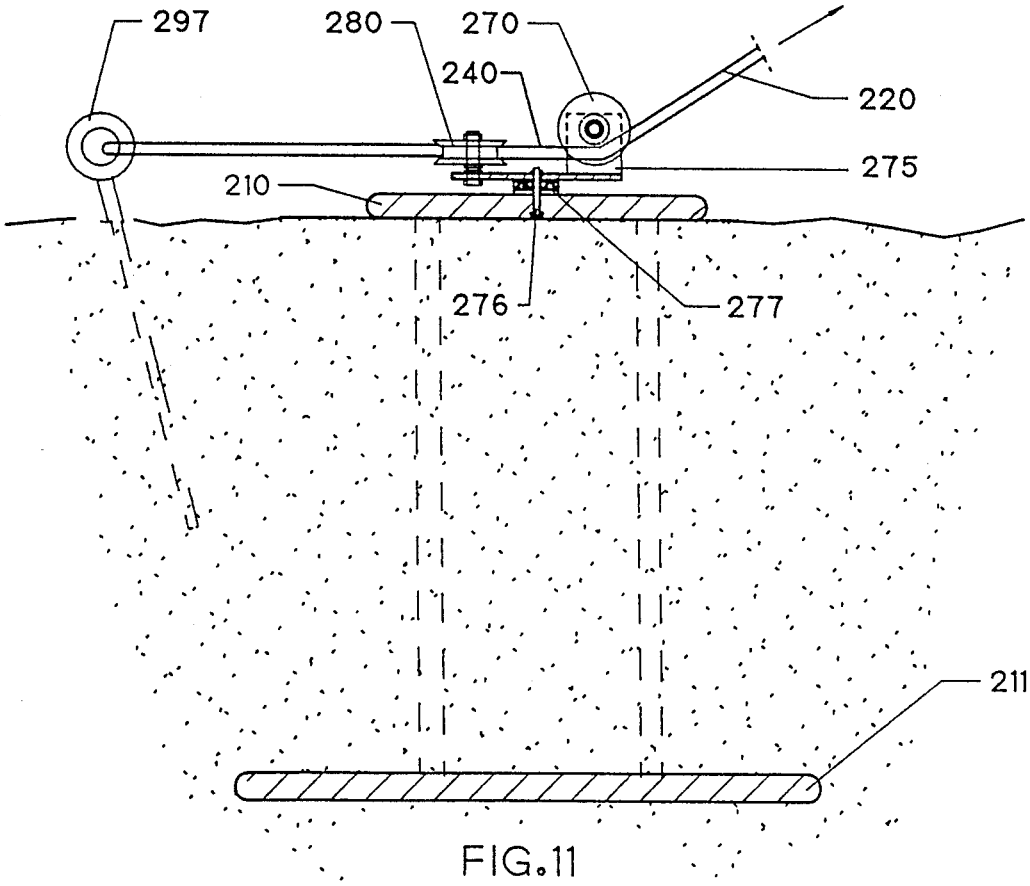
FIG. 11 is an elevation in cross-section taken through lines 11—11 of FIG. 10.

As seen for example in FIGS. 10 and 11, the fixture 297 may comprise a suitable conventional anchor and the base 210 include a lower surface 211 which serves to anchor the base when buried in the sand.

Figure 12:
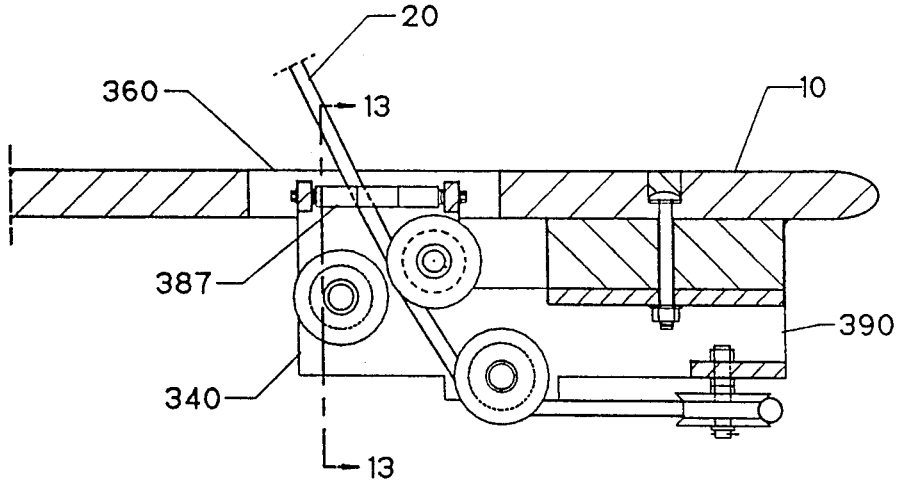
FIG. 12 is a side view of another embodiment of the tracking assembly of the present invention.
Figure 13:
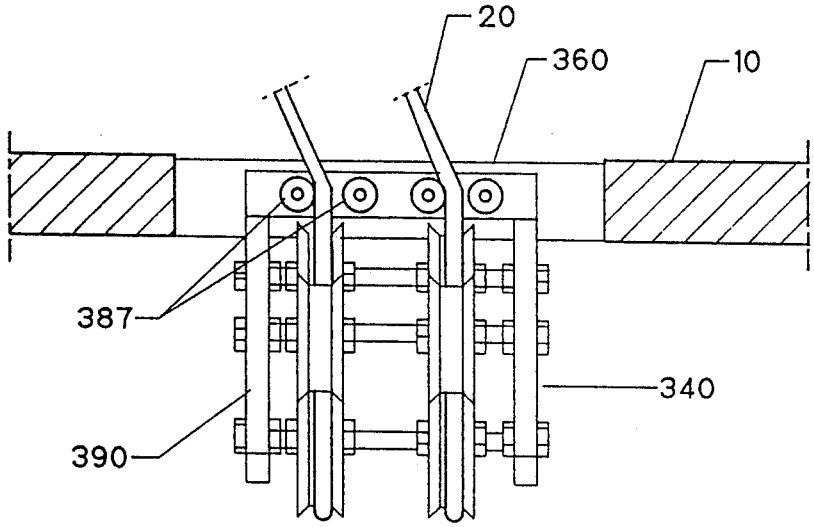
FIG. 13 is an elevation in cross-section taken through lines 13—13 of FIG. 12.

In another embodiment of the present invention shown in FIGS. 12 and 13, the tracking assemblies 340 are immovably affixed to the bottom of the base 10. A pair of roller bearings 387 for each cord 20 are attached to the tracking assembly frame 390 (FIGS. 12 and 13) or to the edge of the cutout section 360 (not shown). The roller bearings 387 ensure low friction egress of the cords 20 from beneath the base 10 while accommodating movement of the user away from the center of the exercise area 12.

Figure 14:
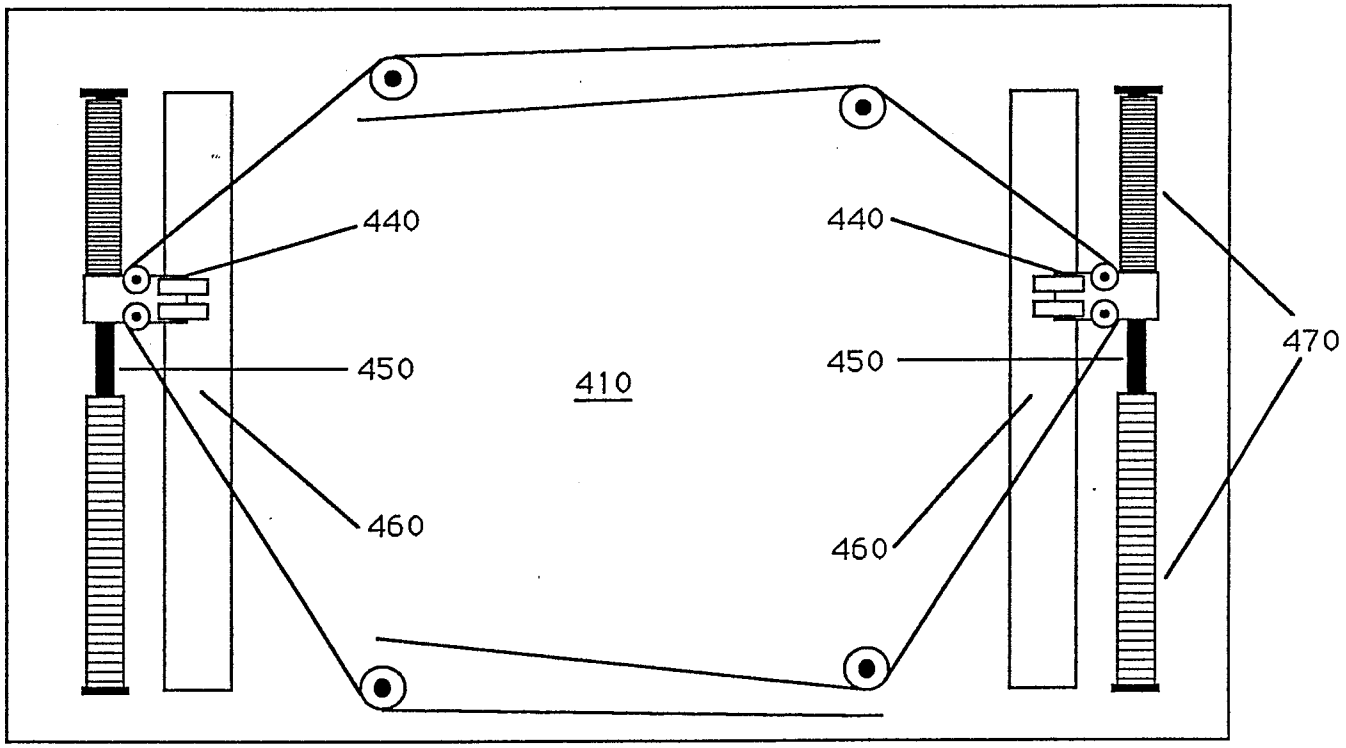
FIG. 14 is a bottom plan view of another embodiment of the present invention showing rail-mounted tracking assemblies.

In a further embodiment of the present invention shown in FIG. 14, the tracking assemblies 440 may be carried by base-mounted rails 450 and slidably moved linearly responsive to off-center motion of the jumper. The base 410 may include cut-out sections 460 corresponding to the range of movement of the tracking assemblies. In FIG. 14, the tracking assemblies are shown uncentered to more clearly represent the rails. The rails 450 may include springs 470 providing forces tending to recenter the tracking assemblies. These forces may be generally perpendicular to the relatively constant forces provided by the cords 20 and should not be so strong as to abruptly pull an off-center jumper to the center of the exercise area and to thereby cause the jumper to lose his balance. The forces provided by springs 470 may be adjusted to suit user needs by using springs of varying strength or by compressibly adjusting the effective length of installed springs. The term spring as used herein encompasses known force providing means, including without limitation coiled springs, hydraulics, pneumatics and shockcords.

While preferred embodiments of the present invention have been described, it is understood that the embodiments described are illustrative only and that the scope of the invention is to be defined solely by the appended claims when accorded a full range of equivalence, many variations and modifications naturally occurring to those skilled in the art from the perusal thereof.

What is claimed is:

1. An exercise apparatus comprising:

(a) base means for forming an exercise area in which vertical jumping exercises may be performed;

(b) plural elastic members for providing a nearly constant resistive force to jumping exercises performed in said exercise area, said force providing elastic members having a direction opposite to the direction of the jumping exercises;

(c) tracking means for directing said elastic members on a path away from said exercise area; and (d) mounting means for movably attaching said tracking means to said base means to maintain said elastic members on said path.

2. A kinetic exercise apparatus comprising:

(a) base means for forming an exercise area;

(b) harness means adapted to be worn in the use of said exercise apparatus;

(c) elastic means attached to said harness means for providing a plurality of first forces opposing motion of said harness means away from said base means, said elastic means having a length whereby each of said first forces is relatively constant over the range of motion of said harness means;

(d) tracking means carried by said base means for directing said elastic means out of said exercise area; and (e) mounting means for movably attaching said tracking means to said base means so that the position of said tracking means relative to the center of said exercise area may change during use of said exercise apparatus.

3. The apparatus as defined in claim 2 wherein said base means comprises a flat upper surface for forming said exercise area, and wherein said tracking means directs said elastic means beneath said flat upper surface.

4. The apparatus as defined in claim 2 wherein said base means comprises two surfaces, each having means for being securably positioned adjacent a generally flat area for forming said exercise area therebetween, and wherein said tracking means directs said elastic means away from the flat area between said two surfaces.

5. The apparatus as defined in claim 2 wherein said harness means comprises a waist belt.

6. The apparatus as defined in claim 2 wherein said elastic means comprises plural elastic cords, each having an unextended length of at least twenty feet.

7. The apparatus as defined in claim 2 wherein said base means comprises adjustment means for selectively varying the effective length of said elastic means to thereby relatively vary each of said first forces.

8. The apparatus as defined in claim 7 wherein the effective length of said elastic means is adjustable from said exercise area.

9. The apparatus as defined in claim 7 wherein said adjustment means comprises one or more one-direction cleats.

10. The apparatus as defined in claim 7 wherein said adjustment means functions without displacing the means defined in parts (a), (b), (d) and (e) of claim 2.

11. The apparatus as defined in claim 7 wherein the effective force of said elastic means emanating from said tracking means may be equalized with respect to one another by observing the position of said tracking means relative to the center of said exercise area.

12. The apparatus as defined in claim 2 wherein said tracking means comprises a frame and plural pulleys attached thereto.

13. The apparatus as defined in claim 2 wherein said mounting means comprises pivoting means for pivotably attaching said tracking means to said base means so that said tracking means move in an arc.

14. The apparatus as defined in claim 2 wherein said mounting means comprises sliding means for slidably attaching said tracking means to said base means so that said tracking means move linearly.

15. The apparatus as defined in claim 14 wherein said mounting means further comprises spring means for providing a plurality of second forces for restoring said sliding means to a position proximate the center of said exercise area.

16. The apparatus as defined in claim 15 further comprising means for adjusting said spring means to thereby relatively vary each of said second forces.

17. The apparatus as defined in claim 2 wherein said mounting means comprises spring means for providing second forces, each generally perpendicular to one of said first forces, tending to restore said harness means to a position proximate the center of said exercise area during use of said exercise apparatus.

18. An exercising apparatus comprising:

(a) flat base means;

(b) harness means;

(c) elastic means for providing a plurality of first forces opposing motion of said harness means away from said base means during exercise, said elastic means having a length whereby each of said first forces is relatively constant over a predetermined range of movement of said harness means during exercise; and (d) tracking means for turning said elastic means to a path generally parallel to said base means, said tracking means comprising:

(1) plural roller bearings for providing low friction movement of said elastic means onto said path, and (2) mounting means for movably attaching said tracking means to said base means to maintain said elastic means on said path.

19. The apparatus as defined in claim 18 wherein said mounting means comprises sliding means for slidably attaching said tracking means to said base means so that said tracking means move linearly.

20. The apparatus as defined in claim 19 wherein said mounting means further comprises spring means for providing a plurality of second forces for restoring said sliding means to a position proximate the center of said base means.

21. The apparatus as defined in claim 20 further comprising means for adjusting said spring means to thereby relatively vary each of said second forces.

22. An exercise apparatus comprising:

(a) an elevated base having a flat upper surface forming an exercise area;

(b) a waist belt adapted to be worn during kinetic exercise in said exercise area;

(c) a first plurality of elastic cords, each cord being affixed to said belt for providing a first plurality of forces opposing movement of said belt away from said exercise area during kinetic exercise;

(d) plural pulleys carried beneath said base for directing the path of said cords over a distance sufficient to maintain said forces approximately constant during kinetic exercise in said exercise area;

(e) adjustment means for selectively varying the effective length of said cords to thereby relatively vary each of said forces;

(f) plural tracking assemblies for providing a low friction change of direction of said cords from said exercise area to a point beneath said base, each of said assemblies comprising a frame and plural pulleys attached thereto; and (g) plural sliding means carried beneath said base, each for slidably carrying one of said tracking assemblies.

* * * * *